US011609531B2

(12) United States Patent
Mizuno

(10) Patent No.: US 11,609,531 B2
(45) Date of Patent: Mar. 21, 2023

(54) IMAGE FORMING APPARATUS REQUIRING LESS EXTERNAL FORCE TO MOVE COVER MEMBER FROM OPEN STATE

(71) Applicant: KYOCERA Document Solutions Inc., Osaka (JP)

(72) Inventor: Masahiko Mizuno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/648,791

(22) Filed: Jan. 24, 2022

(65) Prior Publication Data

US 2022/0236686 A1 Jul. 28, 2022

(30) Foreign Application Priority Data

Jan. 28, 2021 (JP) ..... JP2021-011808

(51) Int. Cl.
*G03G 21/16* (2006.01)
*G03G 21/18* (2006.01)

(52) U.S. Cl.
CPC ..... *G03G 21/1647* (2013.01); *G03G 21/1628* (2013.01); *G03G 21/1633* (2013.01); *G03G 21/1857* (2013.01); *G03G 2221/1657* (2013.01)

(58) Field of Classification Search
CPC ..... G03G 21/1633; G03G 21/1647; G03G 21/1857; G03G 15/00; G03G 21/1628; G03G 2221/1657
See application file for complete search history.

(56) References Cited

U.S. PATENT DOCUMENTS 8,041,258 B2 * 10/2011 Kamimura ..... G03G 21/1842 399/117
2011/0052254 A1 * 3/2011 Hashimoto ..... 399/119
2013/0108324 A1 5/2013 Tamura
2018/0246466 A1 * 8/2018 Hijikata ..... G03G 15/1605
2021/0200140 A1 * 7/2021 Sano

FOREIGN PATENT DOCUMENTS

JP 2013109340 A 6/2013

* cited by examiner

*Primary Examiner* — Sophia S Chen
(74) *Attorney, Agent, or Firm* — Alleman Hall Creasman & Tuttle LLP

(57) ABSTRACT

An image forming apparatus includes a power transmission member, a bias portion, a cam, and an interlocking mechanism. The power transmission member is displaceable between connected and released positions where the power transmission member is respectively connected to and disconnected from the detachable portion, and transmits the driving force of a drive portion to the detachable portion while connected to the detachable portion. The bias portion biases the power transmission member in a first direction to the connected position. The cam pivots from a first position to a second position to displace the power transmission member from the connected position to the released position, and is biased by the bias portion in a second direction to the first position when in the second position. The interlocking mechanism causes the cam to pivot from the first to the second position as a cover member changes its state from closed to open.

11 Claims, 9 Drawing Sheets

IMAGE FORMING APPARATUS REQUIRING LESS EXTERNAL FORCE TO MOVE COVER MEMBER FROM OPEN STATE

INCORPORATION BY REFERENCE

This application is based upon and claims the benefit of priority from the corresponding Japanese Patent Application No. 2021-011808 filed on Jan. 28, 2021, the entire contents of which are incorporated herein by reference.

BACKGROUND

The present disclosure relates to an image forming apparatus.

In an electrophotographic image forming apparatus, a detachable portion such as a developing device is detachably disposed inside a housing and connected to a power transmission member that transmits the driving force of a motor to the detachable portion. A cover member is opened and closed during attachment and removal of the detachable portion, and the detachable portion can be disconnected from the power transmission member as the cover member is opened.

For example, a known image forming apparatus includes a bias portion, a cam, and an interlocking mechanism. The bias portion biases the power transmission member in a direction along which the power transmission member is displaced from a released position where the power transmission member is disconnected from the detachable portion to a connected position where the power transmission member is connected to the detachable portion. The cam is pivotable between a first position and a second position and pivots from the first position to the second position to move the power transmission member from the connected position to the released position. The interlocking mechanism causes the cam to pivot from the first position to the second position in conjunction with the change of state of the cover member from a closed state to an open state and to pivot from the second position to the first position in conjunction with the change of state of the cover member from the open state to the closed state.

SUMMARY

An image forming apparatus according to the present disclosure includes a cover member, a power transmission member, a bias portion, a cam, and an interlocking mechanism. The cover member is capable of opening and closing an opening of a housing, the opening communicating with a detachable portion detachably disposed inside the housing. The power transmission member is displaceable between a connected position where the power transmission member is connected to the detachable portion and a released position where the power transmission member is disconnected from the detachable portion. The power transmission member transmits the driving force of a drive portion to the detachable portion while the power transmission member is connected to the detachable portion. The bias portion biases the power transmission member in a first direction along which the power transmission member is displaced from the released position to the connected position. The cam is pivotable between a first position and a second position set in advance and pivots from the first position to the second position to displace the power transmission member from the connected position to the released position. The cam is biased by the bias portion in a second direction along which the cam pivots to the first position when the cam is in the second position. The interlocking mechanism causes the cam to pivot from the first position to the second position in conjunction with the change of state of the cover member from a closed state to an open state.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 100]

Figure 1:
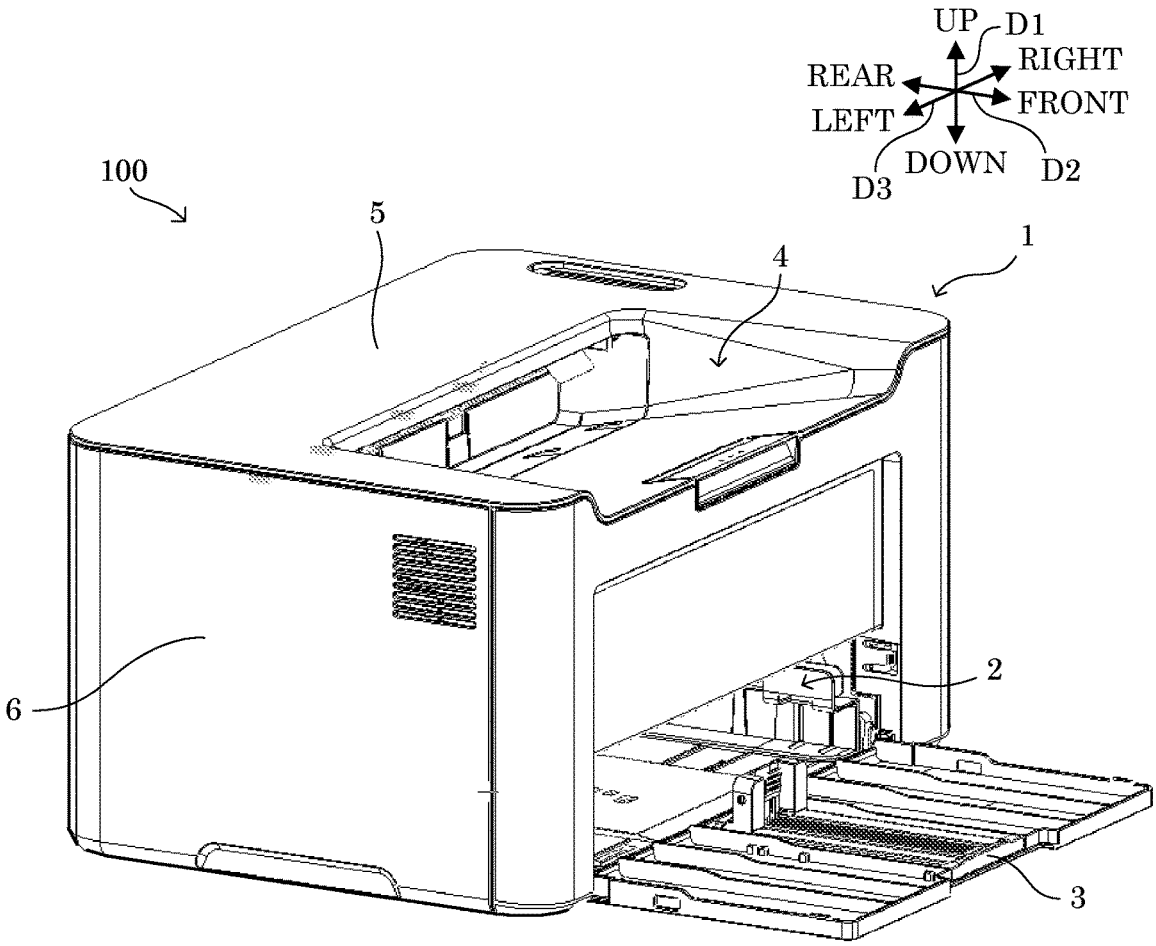
FIG. 1 is a perspective view showing the configuration of an image forming apparatus according to an embodiment of the present disclosure.
Figure 2:
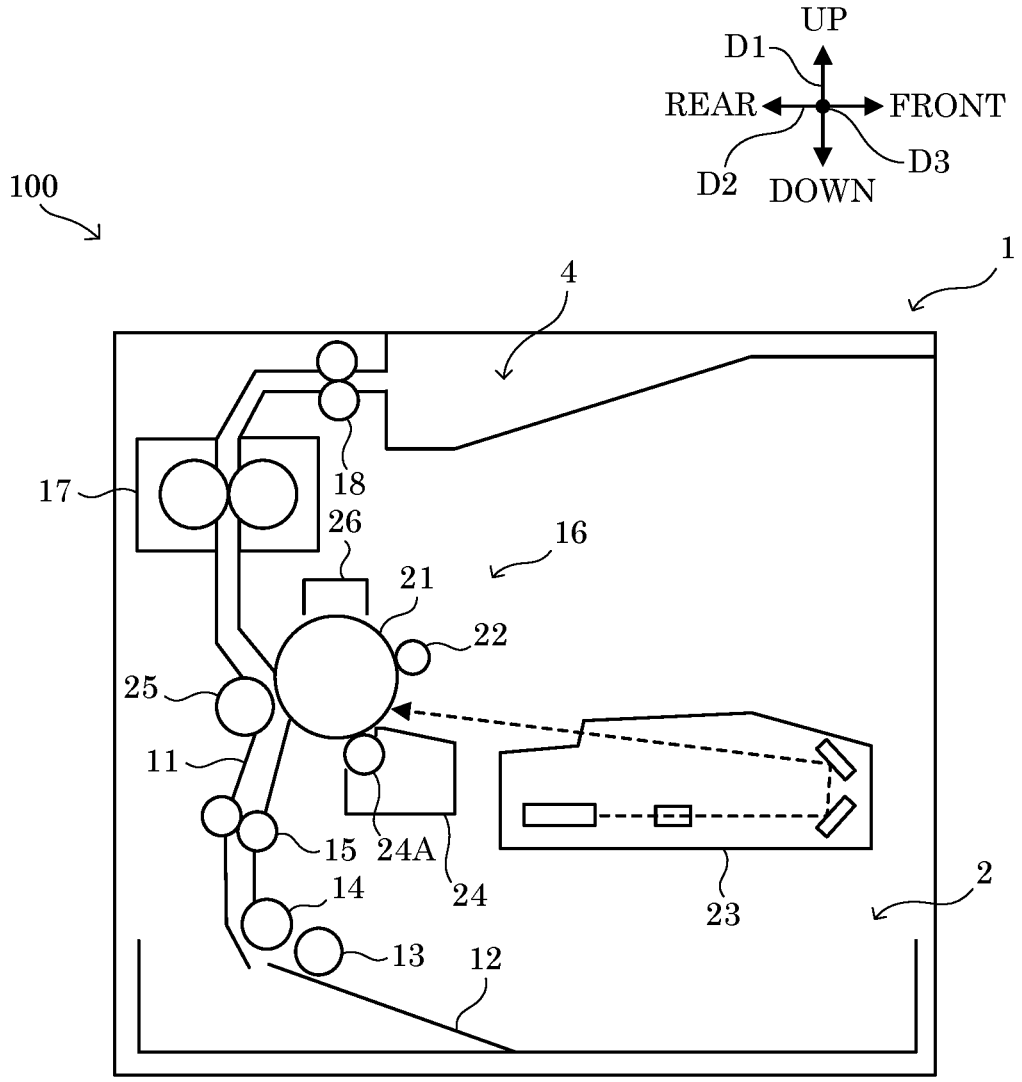
FIG. 2 is a cross-sectional view showing the configuration of the image forming apparatus according to the embodiment of the present disclosure.

First, the configuration of an image forming apparatus 100 according to the embodiment of the present disclosure will be described with reference to FIGS. 1 and 2. Here, FIG. 1 is a perspective view showing the configuration of the image forming apparatus 100. In addition, FIG. 2 is a cross-sectional view showing the configuration of the image forming apparatus 100.

For purposes of illustration, the vertical direction in a state where the image forming apparatus 100 is installed and ready for use (state shown in FIG. 1) is defined as an up-down direction D1. In addition, a front-rear direction D2 is defined on the premise that the face of the image forming apparatus 100 on the right side of the page in FIG. 1 serves as the front (front face). In addition, a left-right direction D3 is defined relative to the front of the image forming apparatus 100 in the installed state.

The image forming apparatus 100 is a printer that forms images by an electrophotographic method. It is noted that the image forming apparatus of the present disclosure may be a facsimile apparatus, a copier, or a multifunction peripheral.

As shown in FIG. 1, the image forming apparatus 100 includes a housing 1. The housing 1 houses components of the image forming apparatus 100. As shown in FIG. 1, the housing 1 is a substantially rectangular parallelepiped.

The housing 1 is provided with a sheet storing portion 2 that stores sheets on which images are to be formed and a front cover 3 that can open and close the sheet storing portion 2 in a lower front portion of the housing 1. In addition, the housing 1 is provided with a top cover 5 in an upper portion thereof. The top cover 5 can open and close an opening 7 (see FIG. 3) formed in the upper portion of the housing 1. The top cover 5 pivots in a pivot direction D4 (see FIG. 3) on a pivot shaft disposed at the upper rear end of the housing 1 and extending in the left-right direction D3. The top cover 5 is provided with a sheet discharge portion 4 to which sheets with images formed thereon are discharged. The top cover 5 is an example of a cover member of the present disclosure.

As shown in FIG. 2, the housing 1 is provided therein with a sheet conveyance path 11, a lift plate 12, a pickup roller 13, a sheet feed roller 14, a conveying roller 15, an image forming portion 16, a fixing device 17, and a sheet discharge roller 18.

The sheet conveyance path 11 is a conveyance path of sheets extending from the sheet storing portion 2 to the sheet discharge portion 4. The lift plate 12 is pivotably disposed at the bottom of the sheet storing portion 2 and configured to push up a stack of sheets housed in the sheet storing portion 2 to a contact position with the pickup roller 13.

The pickup roller 13 comes into contact with the top sheet in the stack of the sheets pushed up by the lift plate 12 and conveys the sheet to the sheet feed roller 14. The sheet feed roller 14 forms a nip portion between itself and a separation member (not shown) and conveys only one sheet of one or more sheets conveyed to the nip portion by the pickup roller 13 to the conveying roller 15.

The conveying roller 15 conveys the sheet to the image forming portion 16 at a predetermined timing. The image forming portion 16 forms a toner image on the sheet conveyed by the conveying roller 15.

The fixing device 17 fixes the toner image formed on the sheet by the image forming portion 16 to the sheet. The sheet discharge roller 18 discharges the sheet with the toner image fixed thereon by the fixing device 17 to the sheet discharge portion 4.

As shown in FIG. 2, the image forming portion 16 includes a photoconductor drum 21, a charging roller 22, a laser scanning unit 23, a developing device 24, a transfer roller 25, and a cleaning device 26.

The photoconductor drum 21 is an object on which electrostatic latent images are formed. The charging roller 22 electrically charges the surface of the photoconductor drum 21. The laser scanning unit 23 emits a light beam based on image data onto the surface of the charged photoconductor drum 21 to form an electrostatic latent image corresponding to the image data on the surface.

The developing device 24 develops the electrostatic latent image formed on the surface of the photoconductor drum 21 using toner. As shown in FIG. 2, the developing device 24 includes a developing roller 24A that conveys toner stored inside the developing device 24 to an area facing the photoconductor drum 21. The developing device 24 is detachably disposed inside the housing 1. The opening 7 (see FIG. 3) of the housing 1 communicates with the developing device 24 disposed inside the housing 1. The top cover 5 is opened and closed during attachment and removal of the developing device 24. The developing device 24 is an example of a detachable portion of the present disclosure.

The transfer roller 25 transfers a toner image on the photoconductor drum 21 developed by the developing device 24 to the sheet conveyed by the conveying roller 15. The cleaning device 26 cleans the surface of the photoconductor drum 21 after the toner image is transferred by the transfer roller 25.

Figure 3:
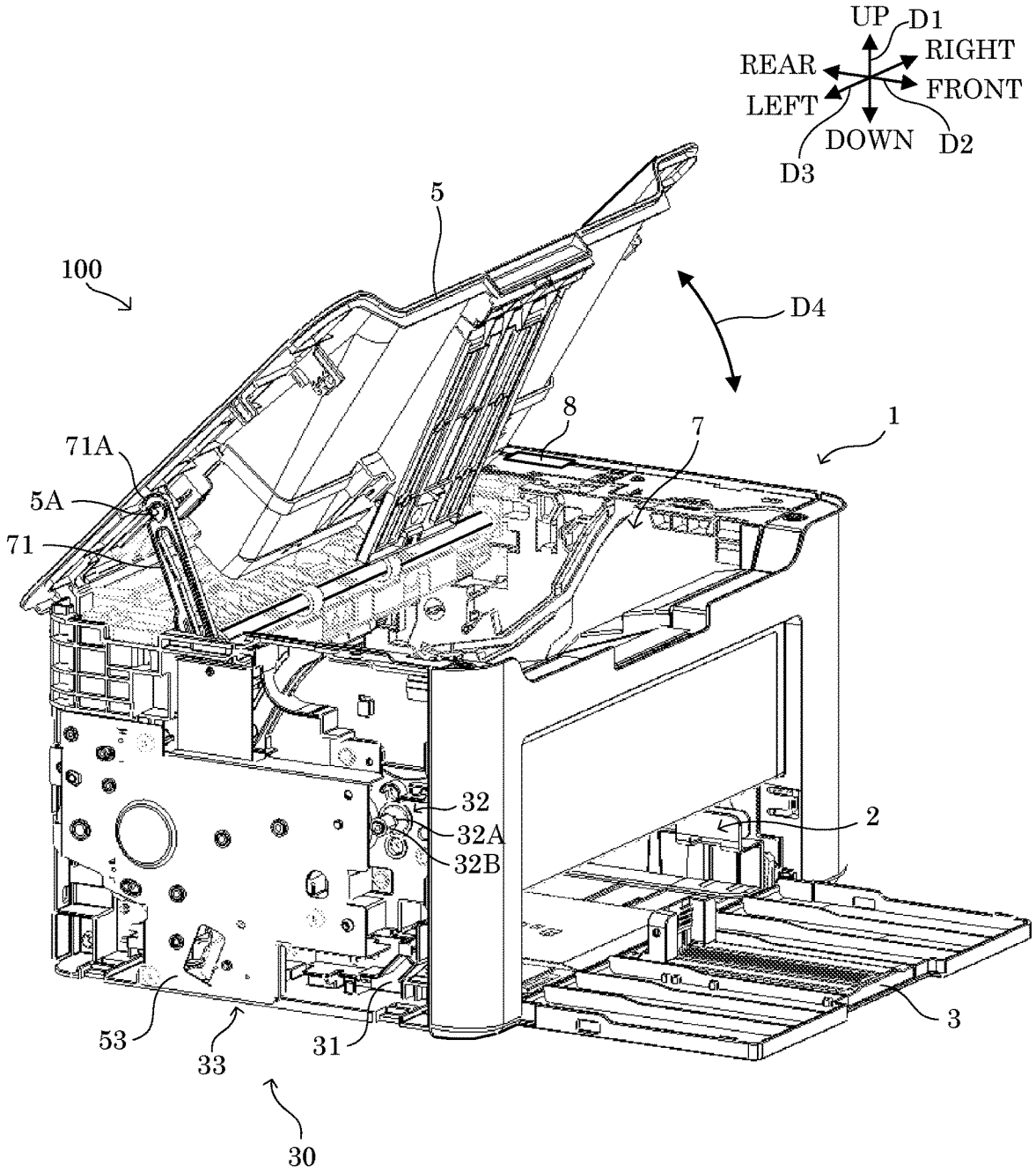
FIG. 3 is a perspective view showing the configuration of a driving-force supply portion of the image forming apparatus according to the embodiment of the present disclosure.

The lift plate 12, the pickup roller 13, the sheet feed roller 14, the conveying roller 15, the fixing device 17, the photoconductor drum 21, and the developing device 24 are driven by a driving force supplied by a driving-force supply portion 30 (see FIG. 3). The driving-force supply portion 30 is disposed inside a left outer wall 6 (see FIG. 1) of the housing 1.

[Configuration of Driving-Force Supply Portion 30]

Figure 4:
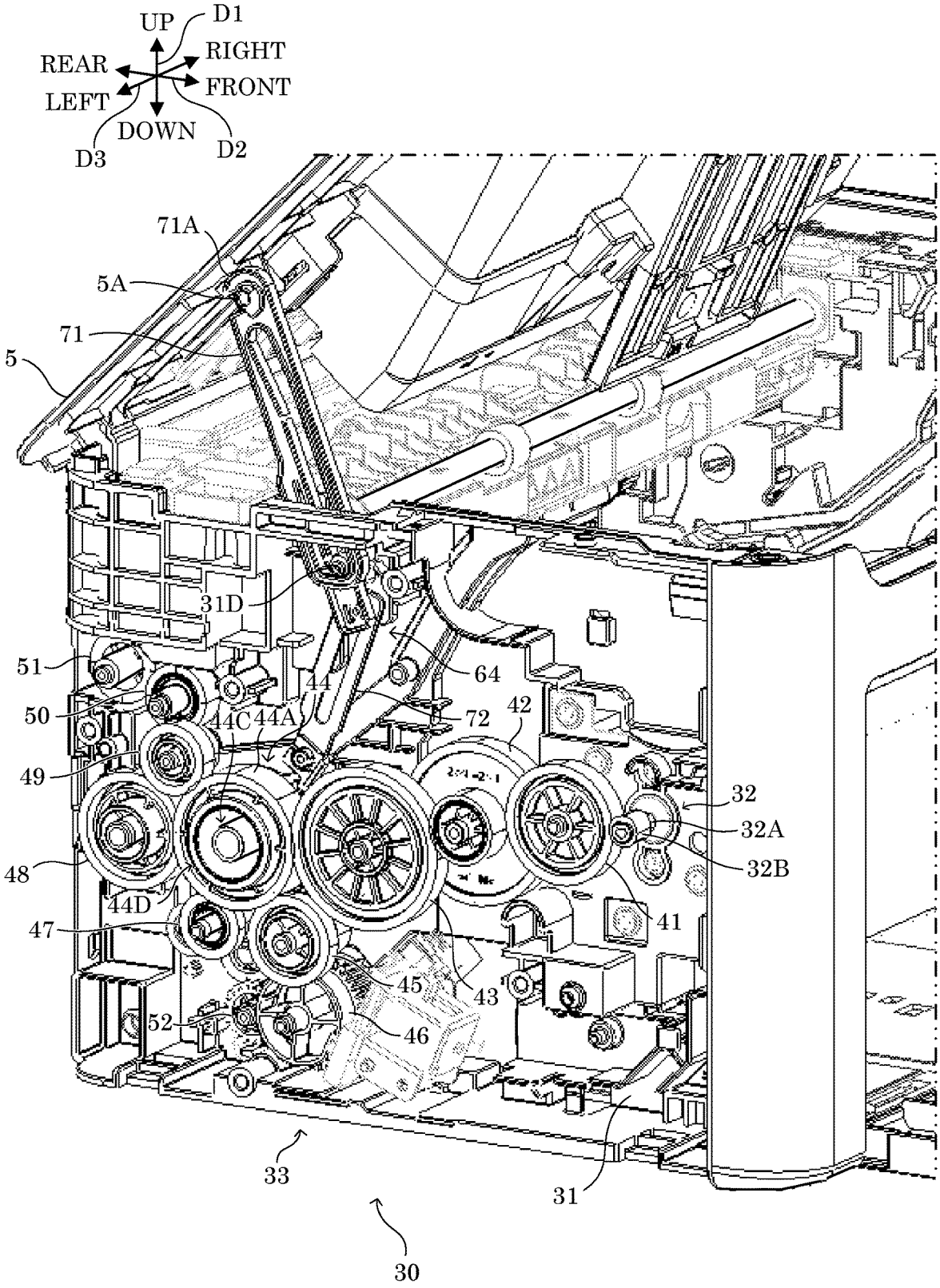
FIG. 4 is a perspective view showing the configuration of the driving-force supply portion of the image forming apparatus according to the embodiment of the present disclosure.

The following describes the configuration of the driving-force supply portion 30 with reference to FIGS. 3 and 4. Here, FIG. 3 is a perspective view showing the housing 1 without the left outer wall 6 and with the top cover 5 open. In addition, FIG. 4 is a perspective view showing the housing 1 without a gear cover 53 (see FIG. 3).

As shown in FIG. 3, the driving-force supply portion 30 includes an inner wall 31, a drive motor 32, and a power transmission mechanism 33.

The inner wall 31 is disposed vertically to face the left outer wall 6 (see FIG. 1) of the housing 1. A storage space that stores components of the power transmission mechanism 33 is left between the inner wall 31 and the left outer wall 6. The inner wall 31 also functions as a support portion that supports the drive motor 32 and the components of the power transmission mechanism 33.

The drive motor 32 generates the driving force to be supplied to driven portions such as the developing device 24. The drive motor 32 is disposed on the right surface of the inner wall 31. As shown in FIGS. 3 and 4, the drive motor 32 includes a drive shaft 32A protruding from the inner wall 31 toward the left outer wall 6 and a drive gear 32B that rotates integrally with the drive shaft 32A. The drive motor 32 is an example of a drive portion of the present disclosure.

The power transmission mechanism 33 transmits the driving force of the drive motor 32 to the driven portions such as the developing device 24. The power transmission mechanism 33 includes a first gear 41, a second gear 42, a third gear 43, a fourth gear 44, a fifth gear 45, a sixth gear 46, a seventh gear 47, an eighth gear 48, a ninth gear 49, a tenth gear 50, an eleventh gear 51, and a twelfth gear 52 shown in FIG. 4. In addition, the power transmission mechanism 33 includes the gear cover 53 shown in FIG. 3.

As shown in FIG. 3, the gear cover 53 is attached to the left surface of the inner wall 31. A storage space that stores the gears included in the power transmission mechanism 33 is left between the gear cover 53 and the inner wall 31. The gears included in the power transmission mechanism 33 are rotatably supported by either the inner wall 31 or the gear cover 53, or both.

As shown in FIG. 4, the first gear 41 is located to the left of the drive gear 32B on the page in FIG. 4 to be adjacent to the drive gear 32B. The first gear 41 meshes with the drive gear 32B and rotates under the driving force supplied from the drive gear 32B.

As shown in FIG. 4, the second gear 42 is located to the left of the first gear 41 on the page in FIG. 4 to be adjacent to the first gear 41. The second gear 42 meshes with the first gear 41 and rotates under the driving force supplied from the first gear 41.

As shown in FIG. 4, the third gear 43 is located to the left of the second gear 42 on the page in FIG. 4 to be adjacent to the second gear 42. The third gear 43 meshes with the second gear 42 and rotates under the driving force supplied from the second gear 42.

As shown in FIG. 4, the fourth gear 44 is located to the left of the third gear 43 on the page in FIG. 4 to be adjacent to the third gear 43. The fourth gear 44 meshes with the third gear 43 and rotates under the driving force supplied from the third gear 43. The fourth gear 44 is connectable to a driven shaft 24B (see FIG. 7) of the developing device 24. The fourth gear 44 supplies the driving force supplied from the third gear 43 to the developing device 24 while being connected to the driven shaft 24B. The driving force supplied from the fourth gear 44 through the driven shaft 24B rotates the developing roller 24A of the developing device 24. The fourth gear 44 is an example of a power transmission member of the present disclosure.

As shown in FIG. 4, the fifth gear 45 is located on the lower right side of the fourth gear 44 on the page in FIG. 4 to be adjacent to the fourth gear 44. The fifth gear 45 meshes with the fourth gear 44 and rotates under the driving force supplied from the fourth gear 44.

As shown in FIG. 4, the sixth gear 46 is located under the fifth gear 45 on the page in FIG. 4 to be adjacent to the fifth gear 45. The sixth gear 46 meshes with the fifth gear 45 and rotates under the driving force supplied from the fifth gear 45. The sixth gear 46 is connected to the pivot shaft of the lift plate 12 and supplies the driving force supplied from the fifth gear 45 to the lift plate 12. The lift plate 12 pivots under the driving force supplied from the sixth gear 46.

As shown in FIG. 4, the seventh gear 47 is located on the lower left side of the fourth gear 44 on the page in FIG. 4 to be adjacent to the fourth gear 44. The seventh gear 47 meshes with the fourth gear 44 and rotates under the driving force supplied from the fourth gear 44. The seventh gear 47 is connected to the rotation shaft of the conveying roller 15 and supplies the driving force supplied from the fourth gear 44 to the conveying roller 15. The conveying roller 15 rotates under the driving force supplied from the seventh gear 47.

As shown in FIG. 4, the eighth gear 48 is located to the left of the fourth gear 44 on the page in FIG. 4 to be adjacent to the fourth gear 44. The eighth gear 48 meshes with the fourth gear 44 and rotates under the driving force supplied from the fourth gear 44. The eighth gear 48 is connected to the rotation shaft of the photoconductor drum 21 and supplies the driving force supplied from the fourth gear 44 to the photoconductor drum 21. The photoconductor drum 21 rotates under the driving force supplied from the eighth gear 48.

As shown in FIG. 4, the ninth gear 49 is located on the upper left side of the fourth gear 44 on the page in FIG. 4 to be adjacent to the fourth gear 44. The ninth gear 49 meshes with the fourth gear 44 and rotates under the driving force supplied from the fourth gear 44.

As shown in FIG. 4, the tenth gear 50 is located over the ninth gear 49 on the page in FIG. 4 to be adjacent to the ninth gear 49. The tenth gear 50 meshes with the ninth gear 49 and rotates under the driving force supplied from the ninth gear 49.

As shown in FIG. 4, the eleventh gear 51 is located on the upper left side of the tenth gear 50 on the page in FIG. 4 to be adjacent to the tenth gear 50. The eleventh gear 51 meshes with the tenth gear 50 and rotates under the driving force supplied from the tenth gear 50. The eleventh gear 51 is connected to a driven shaft of the fixing device 17 and supplies the driving force supplied from the tenth gear 50 to the fixing device 17. The driving force supplied from the tenth gear 50 drives a fixing roller of the fixing device 17.

As shown in FIG. 4, the twelfth gear 52 is located to the left of the sixth gear 46 on the page in FIG. 4 to be adjacent to the sixth gear 46. The twelfth gear 52 meshes with the sixth gear 46 and rotates under the driving force supplied from the sixth gear 46. The twelfth gear 52 is connected to the rotation shaft of the sheet feed roller 14 and supplies the driving force supplied from the sixth gear 46 to the sheet feed roller 14. The sheet feed roller 14 rotates under the driving force supplied from the twelfth gear 52. In addition, the pickup roller 13 rotates in conjunction with the sheet feed roller 14.

Here, in the image forming apparatus 100, the fourth gear 44 is disconnected from the developing device 24 as the top cover 5 is opened. Specifically, the driving-force supply portion 30 includes a clutch portion 34 shown in FIGS. 5 and 6.

[Configurations of Fourth Gear 44 and Clutch Portion 34]

Figure 5:
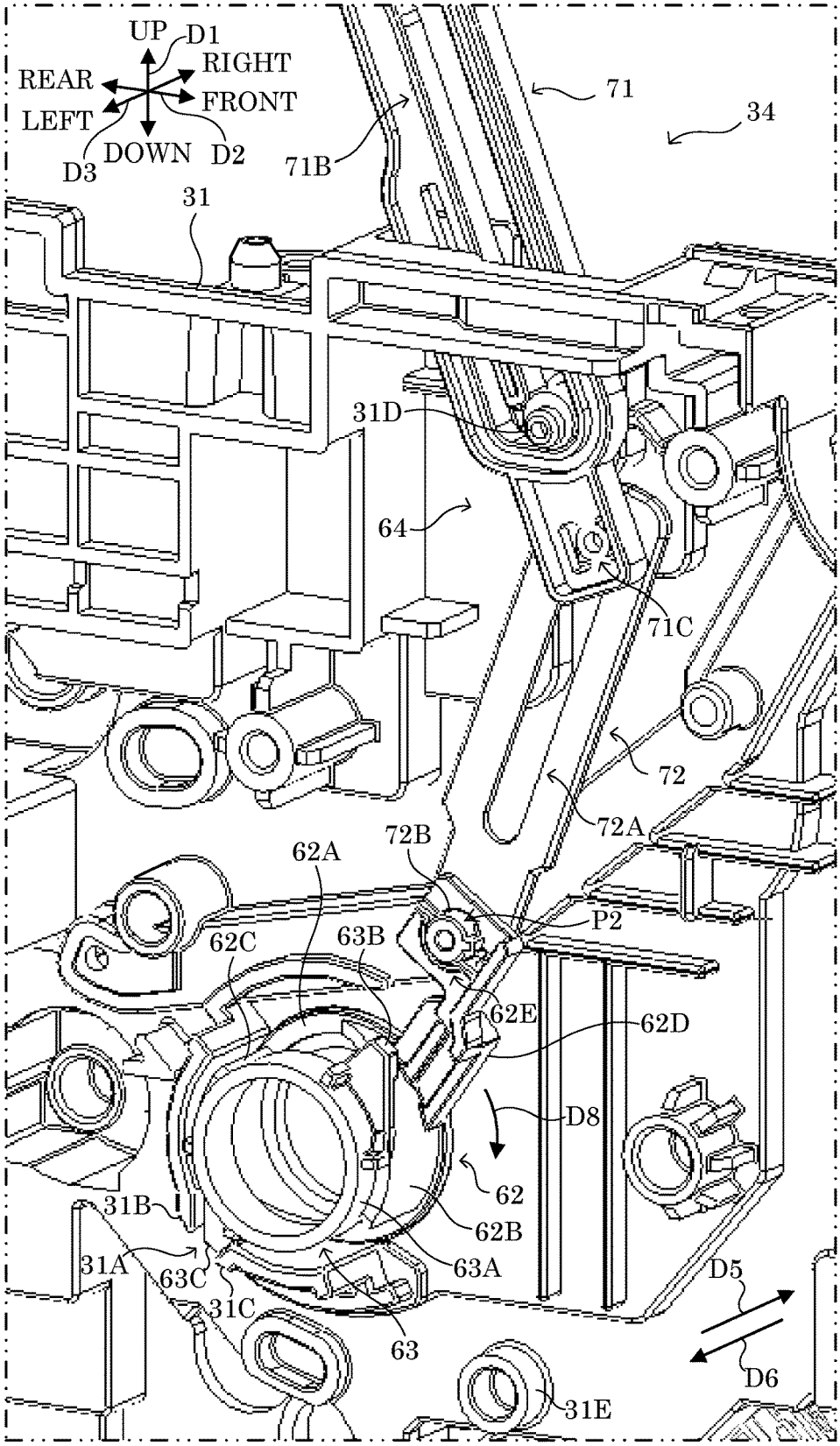
FIG. 5 is a perspective view showing the configuration of a clutch portion of the image forming apparatus according to the embodiment of the present disclosure.
Figure 6:
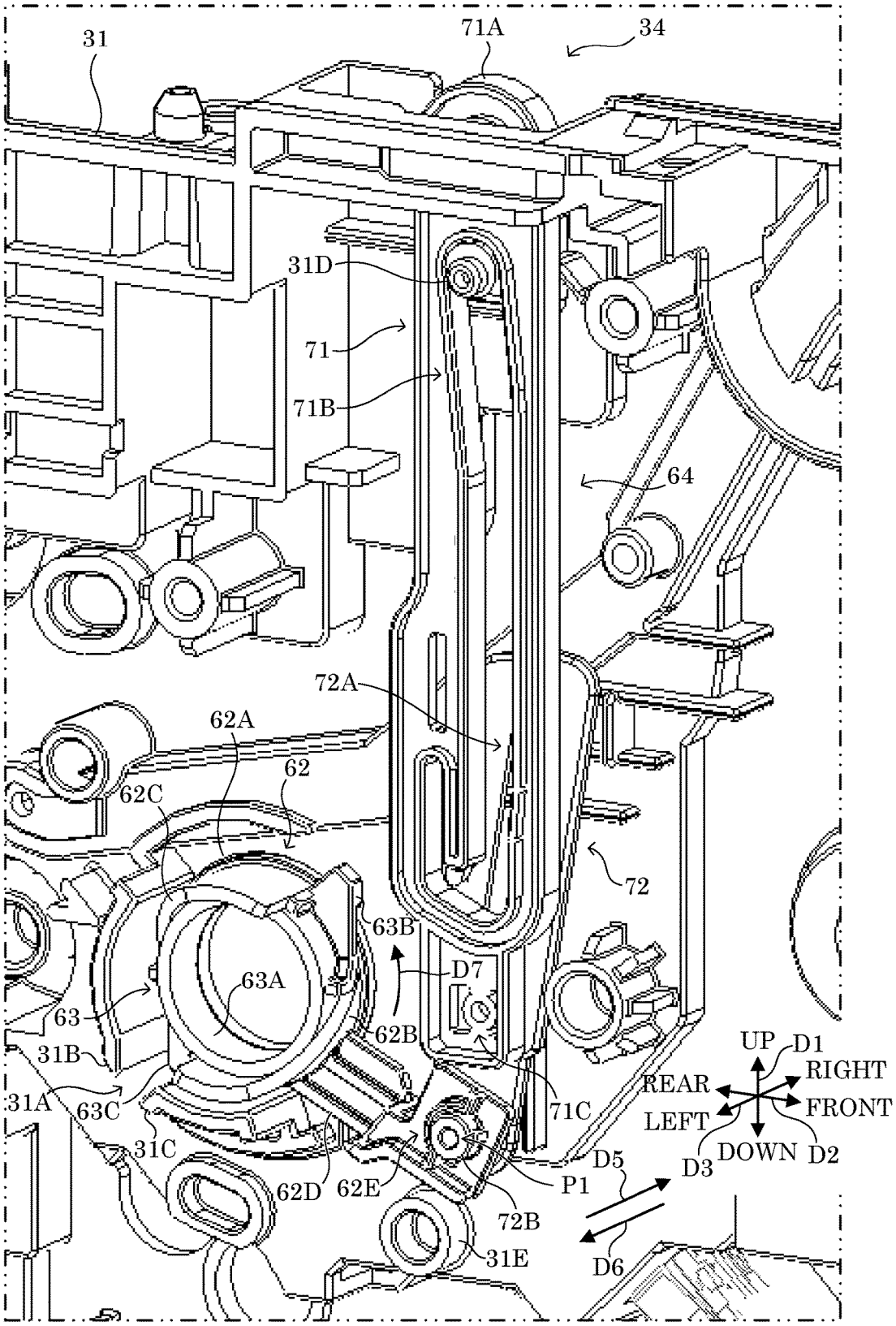
FIG. 6 is a perspective view showing the configuration of the clutch portion of the image forming apparatus according to the embodiment of the present disclosure.
Figure 7:
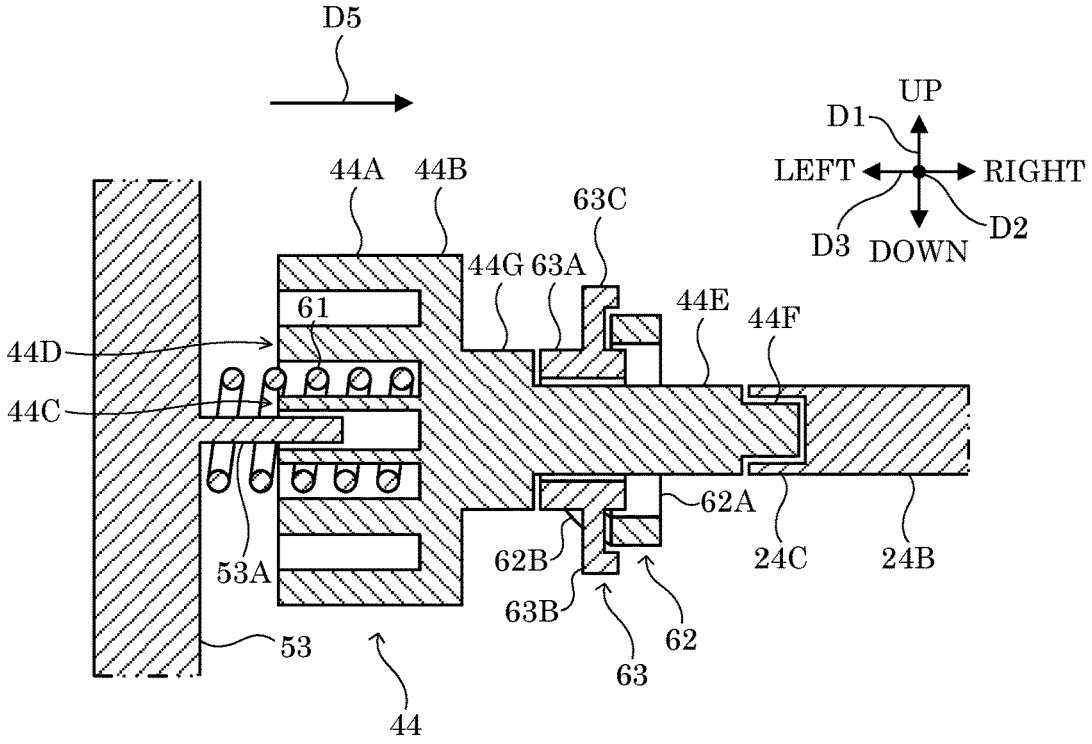
FIG. 7 is a cross-sectional view showing the clutch portion of the image forming apparatus according to the embodiment of the present disclosure.
Figure 8:
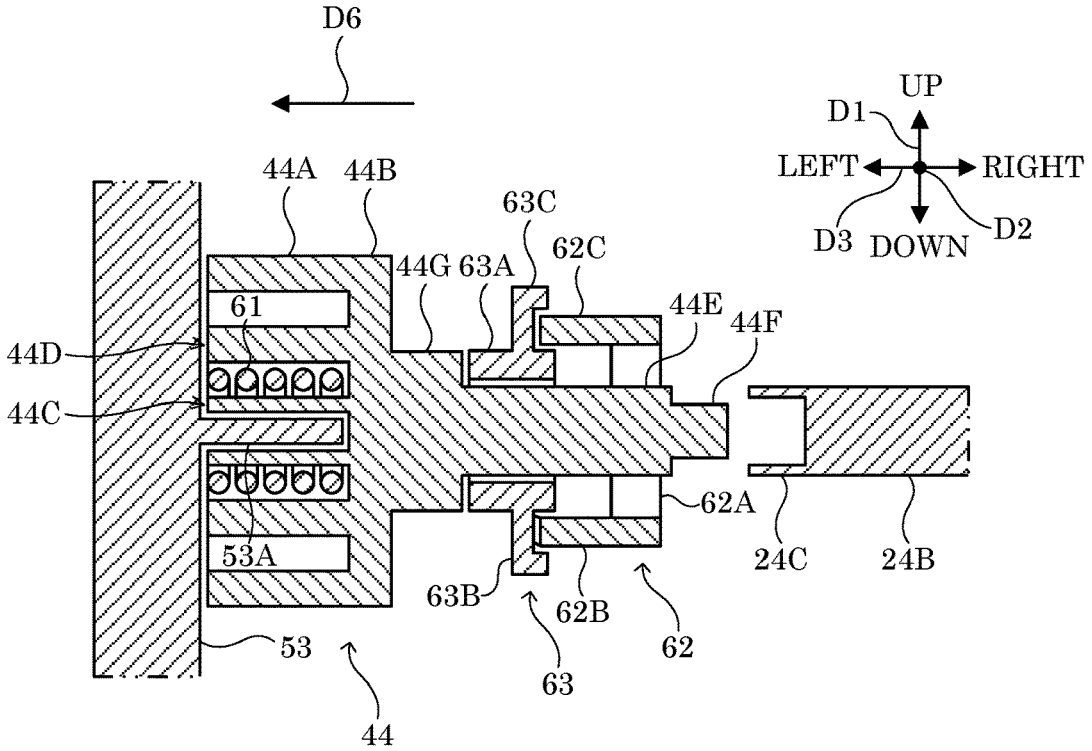
FIG. 8 is a cross-sectional view showing the clutch portion of the image forming apparatus according to the embodiment of the present disclosure.

The following describes the configurations of the fourth gear 44 and the clutch portion 34 with reference to FIGS. 3 to 8. Here, FIG. 5 is a perspective view showing the configuration of the clutch portion 34 when the top cover 5 is open. In addition, FIG. 6 is a perspective view showing the configuration of the clutch portion 34 when the top cover 5 is closed. FIGS. 5 and 6 show the inner wall 31 from which the gears included in the power transmission mechanism 33 are removed. In addition, FIG. 7 is a cross-sectional view showing the clutch portion 34 when the fourth gear 44 is connected to the developing device 24. In addition, FIG. 8 is a cross-sectional view showing the clutch portion 34 when the fourth gear 44 is disconnected from the developing device 24.

The fourth gear 44 is displaceable between a connected position (see FIG. 7) where the fourth gear 44 is connected to the driven shaft 24B of the developing device 24 and a released position (see FIG. 8) where the fourth gear 44 is disconnected from the driven shaft 24B.

As shown in FIGS. 4 and 7, the fourth gear 44 includes a gear portion 44A, a support portion 44B, a bearing portion 44C, a spring housing portion 44D, a rotation shaft 44E, a connection portion 44F, and a pushed portion 44G. For example, these portions are integrally formed into the fourth gear 44 from a material such as synthetic resin.

The gear portion 44A has a ring shape and includes teeth cut in the outer peripheral surface thereof to be meshed with other gears. The support portion 44B has a disk shape and is located to the right of the gear portion 44A. The support portion 44B supports the gear portion 44A, the bearing portion 44C, the spring housing portion 44D, and the rotation shaft 44E.

The bearing portion 44C has a cylindrical shape protruding from the center of the left surface of the support portion 44B to the left. The bearing portion 44C is formed inside the gear portion 44A. A rotation shaft 53A (see FIG. 7) protruding from the right surface of the gear cover 53 to the right is placed through the bearing portion 44C. The fourth gear 44 is rotatably supported by the rotation shaft 53A of the gear cover 53. The fourth gear 44 is also supported by the rotation shaft 53A of the gear cover 53 to be movable in the left-right direction D3.

The spring housing portion 44D has a cylindrical shape protruding from the left surface of the support portion 44B to the left. The spring housing portion 44D is formed inside the gear portion 44A and outside the bearing portion 44C. As shown in FIG. 7, a coil spring 61 is housed between an outer perimeter of the bearing portion 44C and the inner perimeter of the spring housing portion 44D.

The rotation shaft 44E extends from the center of the right surface of the support portion 44B in a bias direction D5 of the coil spring 61 (see FIG. 7). The rotation shaft 44E is coaxial to the rotation shaft 53A of the gear cover 53. The rotation shaft 44E rotates under the driving force supplied from the third gear 43.

The connection portion 44F is provided at the extended end of the rotation shaft 44E. The connection portion 44F has a shape meshable with a connected portion 24C (see FIG. 7) formed at the distal end of the driven shaft 24B of the developing device 24. The connection portion 44F meshing with the connected portion 24C connects the fourth gear 44 to the developing device 24. The position where the connection portion 44F meshes with the connected portion 24C (see FIG. 7) corresponds to the connected position. In addition, the position where the connection portion 44F is disconnected from the connected portion 24C (see FIG. 8) corresponds to the released position. The fourth gear 44 moves in the left-right direction D3 to be displaced between the connected position and the released position.

The pushed portion 44G is formed on the right surface of the support portion 44B to cover the proximal end of the rotation shaft 44E. The pushed portion 44G is formed to be brought into contact with a pushing member 63 (see FIG. 7) at a position to the right of the right surface of the support portion 44B.

The clutch portion 34 includes the coil spring 61 (see FIG. 7), a cam 62 (see FIG. 5), the pushing member 63 (see FIG. 5), and a link mechanism 64 (see FIG. 5).

The coil spring 61 biases the fourth gear 44 in the bias direction D5 (see FIG. 7) along which the fourth gear 44 is displaced from the released position to the connected position. As shown in FIG. 7, the coil spring 61 is disposed between the gear cover 53 and the fourth gear 44. In addition, the coil spring 61 is housed in the spring housing portion 44D of the fourth gear 44. The coil spring 61 is an example of a bias portion of the present disclosure. In addition, the bias direction D5 is an example of a first direction of the present disclosure. It is noted that any other means capable of biasing the fourth gear 44 in the bias direction D5 may be used instead of the coil spring 61.

The cam 62 is pivotable between a first position P1 (see FIG. 6) and a second position P2 (see FIG. 5) set in advance. The cam 62 pivots from the first position P1 to the second position P2 to displace the fourth gear 44 from the connected position to the released position.

As shown in FIG. 5, the cam 62 includes a first pivot portion 62A, a first inclined portion 62B, a second inclined portion 62C, a protruding portion 62D, and an engaged portion 62E.

The first pivot portion 62A is pivotable on the rotation shaft 44E of the fourth gear 44. As shown in FIGS. 5 and 7, the first pivot portion 62A has a ring shape enclosing the rotation shaft 44E.

The first inclined portion 62B includes a first inclined surface 62B1 (see FIG. 10) inclined from an end of the first pivot portion 62A facing a push direction D6 (see FIG. 8) opposite the bias direction D5, that is, from the left end of the first pivot portion 62A to the left in a second pivot direction D8 (see FIG. 5) along which the cam 62 pivots from the second position P2 to the first position P1. The first inclined portion 62B is an example of an inclined portion of the present disclosure. In addition, the second pivot direction D8 is an example of a second direction of the present disclosure.

As does the first inclined portion 62B, the second inclined portion 62C includes an inclined surface inclined from the left end of the first pivot portion 62A to the left in the second pivot direction D8. The first inclined portion 62B and the second inclined portion 62C are symmetric to each other about the pivot center of the first pivot portion 62A.

The protruding portion 62D protrudes outward from an outer peripheral portion of the first pivot portion 62A in a radial direction of the first pivot portion 62A. The engaged portion 62E is provided at the protruding end of the protruding portion 62D, and an engagement pin 72B (see FIG. 5) of a second link member 72 of the link mechanism 64 is placed through the engaged portion 62E.

The pushing member 63 pushes the fourth gear 44 in the push direction D6 (see FIG. 8) as the cam 62 pivots from the first position P1 to the second position P2. The push direction D6 is an example of a third direction of the present disclosure.

Specifically, the pushing member 63 is disposed on a side of the cam 62 facing the push direction D6 to be displaceable in the push direction D6. In addition, the pushing member 63 is displaced in the push direction D6 by the first inclined portion 62B and the second inclined portion 62C that pivot in a first pivot direction D7 (see FIG. 6) opposite the second pivot direction D8 to push the pushed portion 44G of the fourth gear 44 in the push direction D6. The first pivot direction D7 is an example of a fourth direction of the present disclosure.

As shown in FIG. 5, the pushing member 63 includes a second pivot portion 63A, a first contact portion 63B, and a second contact portion 63C.

As shown in FIGS. 5 and 7, the second pivot portion 63A has a ring shape enclosing the rotation shaft 44E of the fourth gear 44. The second pivot portion 63A has an outside diameter smaller than the inside diameter of the first pivot portion 62A.

The first contact portion 63B protrudes outward from an outer peripheral portion of the second pivot portion 63A in a radial direction of the second pivot portion 63A and comes into contact with the first inclined portion 62B of the cam 62. The first contact portion 63B is an example of a contact portion of the present disclosure.

As does the first contact portion 63B, the second contact portion 63C protrudes outward from an outer peripheral portion of the second pivot portion 63A in a radial direction of the second pivot portion 63A and comes into contact with the second inclined portion 62C of the cam 62. The first contact portion 63B and the second contact portion 63C are symmetric to each other about the pivot center of the second pivot portion 63A.

The pushing member 63 is restricted from pivoting on the rotation shaft 44E of the fourth gear 44 by a pivot restricting portion 31A (see FIG. 5) provided for the inner wall 31.

As shown in FIG. 5, the pivot restricting portion 31A is a guide slit left between a first restricting portion 31B and a second restricting portion 31C. The first restricting portion 31B is a wall portion raised upright from the inner wall 31 along the outer perimeter of the first pivot portion 62A of the cam 62. The first restricting portion 31B is disposed behind the cam 62. In addition, as is the first restricting portion 31B, the second restricting portion 31C is a wall portion raised upright from the inner wall 31 along the outer perimeter of the first pivot portion 62A of the cam 62. The second restricting portion 31C is disposed under the cam 62.

The first restricting portion 31B and the second restricting portion 31C are disposed to have the protruding end of the second contact portion 63C of the pushing member 63 therebetween. The pushing member 63 is restricted from pivoting on the rotation shaft 44E of the fourth gear 44 by the first restricting portion 31B and the second restricting portion 31C that have the second contact portion 63C therebetween.

The link mechanism 64 causes the cam 62 to pivot from the first position P1 (see FIG. 6) to the second position P2 (see FIG. 5) in conjunction with the change of state of the top cover 5 from a closed state to an open state. The link mechanism 64 is an example of an interlocking mechanism of the present disclosure.

In addition, the link mechanism 64 causes the cam 62 to pivot from the second position P2 to the first position P1 in conjunction with the change of state of the top cover 5 from the open state to the closed state.

As shown in FIGS. 4 and 5, the link mechanism 64 includes a first link member 71 and the second link member 72.

The first link member 71 has a shape elongated in one direction. As shown in FIGS. 4 and 5, the first link member 71 includes an engaged portion 71A, a slotted portion 71B, and an engagement pin 71C.

The engaged portion 71A is provided at a longitudinal end of the first link member 71. The engaged portion 71A has a hook shape and engages with an engagement pin 5A (see FIG. 3) provided for the top cover 5. As shown in FIG. 3, the engagement pin 5A protrudes to the left from the underside of a left end portion of the top cover 5. The first link member 71 is supported to be pivotable on the engagement pin 5A by the engagement of the engaged portion 71A with the engagement pin 5A.

The slotted portion 71B is formed in the first link member 71 in the longitudinal direction of the first link member 71. An engagement pin 31D (see FIG. 5) provided for the inner wall 31 is placed through the slotted portion 71B. As shown in FIG. 5, the engagement pin 31D protrudes from the inner wall 31 to the left. The engagement pin 31D is disposed above the cam 62. The engagement pin 31D placed through the slotted portion 71B defines the travel path of the engagement pin 71C of the first link member 71 when the top cover 5 is opened and closed. In addition, the slotted portion 71B and the engagement pin 31D define the pivot range of the top cover 5. Specifically, the top cover 5 can pivot upward in the pivot direction D4 until the end of the slotted portion 71B adjacent to the engagement pin 71C comes into contact with the engagement pin 31D.

The engagement pin 71C is provided at another longitudinal end of the first link member 71. The engagement pin 71C protrudes to the right. The engagement pin 71C is fitted in a slotted portion 72A of the second link member 72.

The second link member 72 has a shape elongated in one direction. As shown in FIG. 5, the second link member 72 includes the slotted portion 72A and the engagement pin 72B.

The slotted portion 72A is formed in the second link member 72 in the longitudinal direction of the second link member 72. The engagement pin 71C of the first link member 71 is placed through the slotted portion 72A.

The engagement pin 72B is provided at a longitudinal end of the second link member 72. The engagement pin 72B protrudes to the left. The engagement pin 72B is placed through the engaged portion 62E of the cam 62. The second link member 72 is pivotably supported by the engaged portion 62E by placing the engagement pin 72B through the engaged portion 62E.

Here, the following describes the operation of the link mechanism 64 when the top cover 5 is opened and closed.

When the top cover 5 pivots upward in the pivot direction D4 (see FIG. 3) from the closed state shown in FIG. 6, the first link member 71 engaged with the top cover 5 is pulled upward, and the engagement pin 71C of the first link member 71 is displaced upward. Once the engagement pin 71C comes into contact with the upper end of the slotted portion 72A of the second link member 72, the upward pulling force is applied to the second link member 72 through the contact portion of the engagement pin 71C with the upper end, and the second link member 72 is pulled upward. Thus, the upward pulling force is also applied to the protruding portion 62D of the cam 62 engaged with the second link member 72, and the cam 62 pivots from the first position P1 to the second position P2 in the first pivot direction D7. It is noted that the cam 62 is restricted from pivoting in the first pivot direction D7 beyond the second position P2 by the engagement pin 31D (see FIG. 5) that comes into contact with the end of the slotted portion 71B adjacent to the engagement pin 71C. As shown in FIG. 5, when the top cover 5 is open, the second link member 72 and the protruding portion 62D of the cam 62 pulled upward are stretched out to range substantially in one direction.

When the top cover 5 pivots downward in the pivot direction D4 (see FIG. 3) from the open state shown in FIG. 5, the first link member 71 engaged with the top cover 5 is pushed downward, and the engagement pin 71C of the first link member 71 is displaced downward. Once the engagement pin 71*C comes* into contact with the lower end of the slotted portion 72A of the second link member 72, the downward pushing force is applied to the second link member 72 through the contact portion of the engagement pin 71C with the lower end. Thus, the downward pushing force is also applied to the protruding portion 62D of the cam 62 engaged with the second link member 72, and the cam 62 pivots from the second position P2 to the first position P1 in the second pivot direction D8. It is noted that the cam 62 is restricted from pivoting in the second pivot direction D8 beyond the first position P1 by a restricting boss 31E (see FIG. 6) provided for the inner wall 31.

Figure 9:
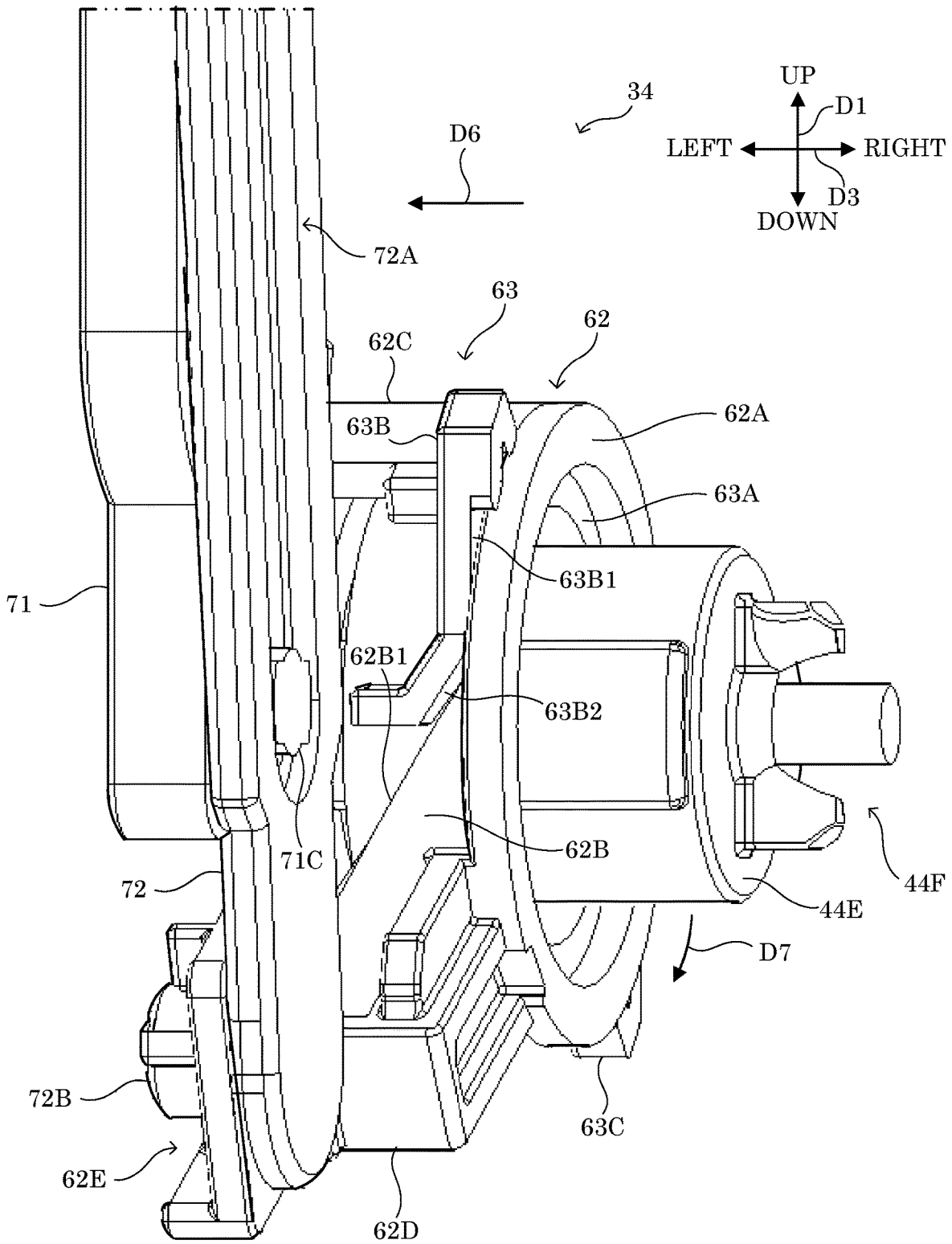
FIG. 9 is a perspective view showing the configuration of the clutch portion of the image forming apparatus according to the embodiment of the present disclosure.
Figure 10:
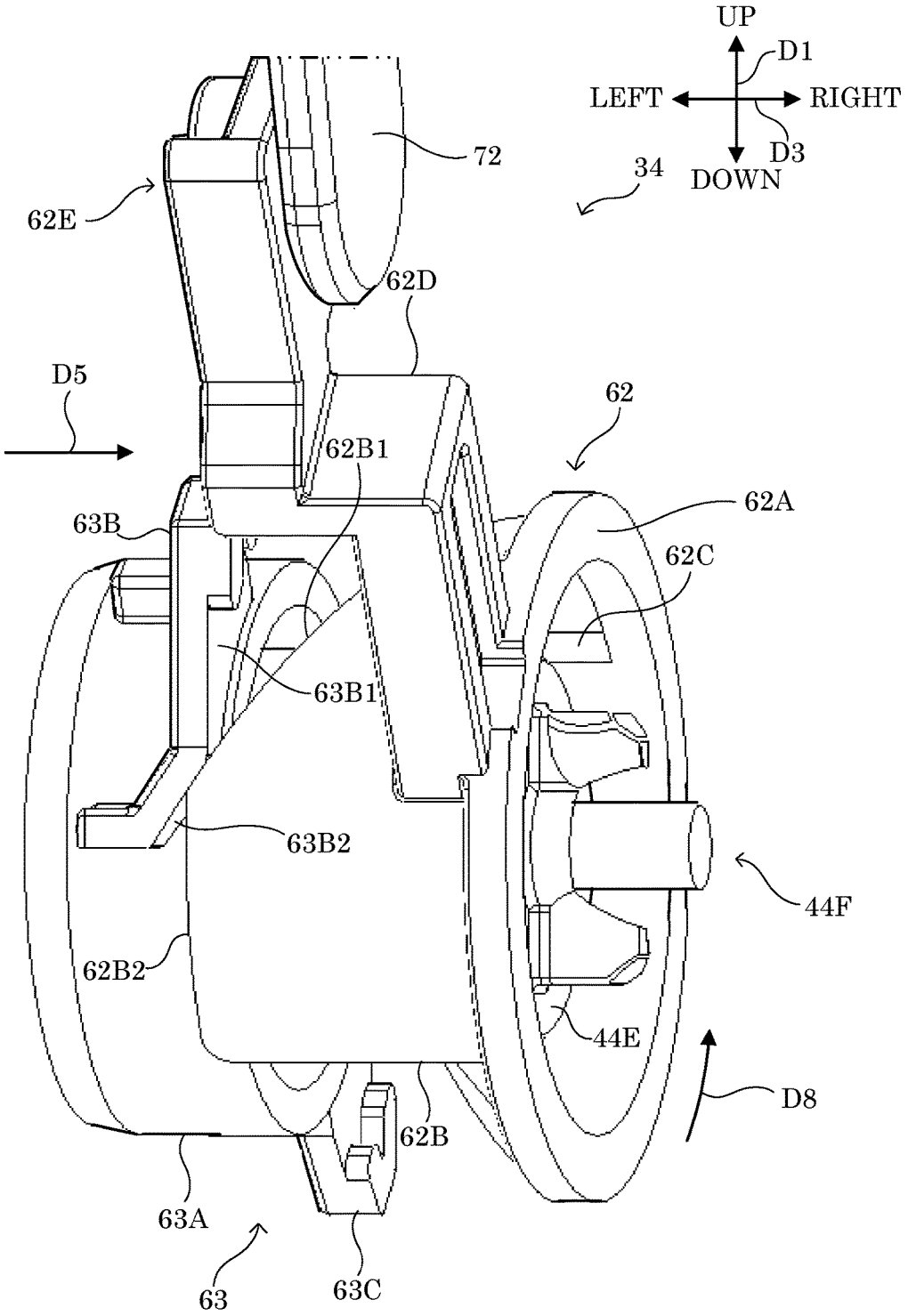
FIG. 10 is a perspective view showing the configuration of the clutch portion of the image forming apparatus according to the embodiment of the present disclosure.

The following describes the contact portion of the cam 62 and the pushing member 63 with reference to FIGS. 9 and 10. Here, FIG. 9 is a perspective view showing the configuration of the clutch portion 34 when the top cover 5 is closed, that is, when the cam 62 is disposed in the first position P1 (see FIG. 6). In addition, FIG. 10 is a perspective view showing the configuration of the clutch portion 34 when the top cover 5 is open, that is, when the cam 62 is disposed in the second position P2 (see FIG. 5).

As shown in FIG. 10, the first inclined portion 62B of the cam 62 includes a first flat surface 62B2. It is noted that the second inclined portion 62C has the same shape as the first inclined portion 62B.

The first flat surface 6262 adjoins the end of the first inclined surface 62B1 facing in the second pivot direction D8 and is parallel to the left end face of the first pivot portion 62A.

As shown in FIGS. 9 and 10, the first contact portion 63B of the pushing member 63 includes a second flat surface 63B1 and a second inclined surface 63B2.

The second flat surface 63B1 is formed along the outer peripheral portion of the second pivot portion 63A and is parallel to the left end face of the first pivot portion 62A of the cam 62. As shown in FIG. 9, the second flat surface 63B1 is in surface contact with the left end face of the first pivot portion 62A of the cam 62 when the cam 62 is disposed in the first position P1 (see FIG. 6).

The second inclined surface 6362 adjoins the end of the second flat surface 63B1 facing in the second pivot direction D8 and is parallel to the first inclined surface 62B1 of the first inclined portion 62B of the cam 62. The second inclined surface 63B2 comes into surface contact with the first inclined surface 62B1 of the first inclined portion 62B (see FIG. 10) when the cam 62 pivots from the first position P1 (see FIG. 6) to the second position P2 (see FIG. 5). The second inclined surface 6362 is an example of a contact surface of the present disclosure. This achieves smooth displacement of the pushing member 63 in the push direction D6 as the cam 62 pivots. It is noted that the first contact portion 63B may not necessarily include the second inclined surface 63B2.

While the top cover 5 changes its state from the closed state to the open state, the biasing force of the coil spring 61 in the bias direction D5 is converted into that in the second pivot direction D8 at the contact portion of the second inclined surface 63B2 and the first inclined surface 62B1 (see FIG. 10). Accordingly, the cam 62 receives the biasing force of the coil spring 61 in the second pivot direction D8.

Here, in a case where the first contact portion 63B rides up on the first flat surface 62B2 of the first inclined portion 62B while the top cover 5 changes its state from the closed state to the open state, the cam 62 does not receive the biasing force of the coil spring 61 in the second pivot direction D8 while the top cover 5 is open. Accordingly, the top cover 5 may not move smoothly from the open state during closing of the top cover 5.

By contrast, the cam 62 in the image forming apparatus 100 according to the embodiment of the present disclosure receives the biasing force of the coil spring 61 in the second pivot direction D8 converted from the bias direction D5 when the cam 62 is in the second position P2 (see FIG. 5). That is, the first contact portion 63B is configured not to ride up on the first flat surface 62B2 of the first inclined portion 62B (see FIG. 10) while the top cover 5 changes its state from the closed state to the open state.

Specifically, in the image forming apparatus 100, when the cam 62 is disposed in the second position P2 (see FIG. 5), the second inclined surface 63B2 of the first contact portion 63B is in surface contact with the first inclined surface 62B1 of the first inclined portion 62B (see FIG. 10).

For example, adjusting the distance of the first inclined surface 62B1 in the second pivot direction D8 and the pivot angle of the cam 62 when the cam 62 pivots from the first position P1 to the second position P2 can prevent the first contact portion 63B from riding up on the first flat surface 62B2 of the first inclined portion 62B.

The image forming apparatus 100 further includes a closure preventing portion 8 shown in FIG. 3.

The closure preventing portion 8 can prevent the change of state of the top cover 5 from the open state to the closed state. For example, the closure preventing portion 8 can change its position, in response to user operations, between a prevention position where the top cover 5 is prevented from changing its state from the open state and a housed position where the closure preventing portion 8 is housed in a depression formed above the opening 7. This prevents the top cover 5 from being automatically closed by the self-weight and the biasing force of the coil spring 61 in the second pivot direction D8 converted from the bias direction D5.

It is noted that the closure preventing portion 8 may be achieved by a configuration different from that described above. In addition, the image forming apparatus 100 may not necessarily include the closure preventing portion 8.

As described above, in the image forming apparatus 100, the cam 62 is biased by the coil spring 61 in the second pivot direction D8 when the cam 62 is in the second position P2 (see FIG. 5). This reduces the external force required to disconnect the fourth gear 44 from the developing device 24 as the top cover 5 is opened and to move the top cover 5 from the open state.

It is noted that the fourth gear 44 may be connected to the photoconductor drum 21, a drum unit including the photoconductor drum 21, the fixing device 17, or the like.

In addition, a mechanism that causes the cam 62 to pivot from the first position P1 to the second position P2 in conjunction with the change of state of the top cover 5 from the closed state to the open state using, for example, a wire may be provided instead of the link mechanism 64. This mechanism may not be necessarily able to cause the cam 62 to pivot from the second position P2 to the first position P1 in conjunction with the change of state of the top cover 5 from the open state to the closed state.

In addition, the cam 62 and the pushing member 63 may have any configurations other than those described above, and any modifications may be made thereto as long as they do not affect the objects of the present disclosure.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a cover member capable of opening and closing an opening of a housing, the opening communicating with a detachable portion detachably disposed inside the housing;

a power transmission member displaceable between a connected position where the power transmission member is connected to the detachable portion and a released position where the power transmission member is disconnected from the detachable portion and configured to transmit driving force of a drive portion to the detachable portion while the power transmission member is connected to the detachable portion;

a bias portion configured to bias the power transmission member in a first direction along which the power transmission member is displaced from the released position to the connected position;

a cam pivotable between a first position and a second position set in advance, configured to pivot from the first position to the second position to displace the power transmission member from the connected position to the released position, and biased by the bias portion in a second direction along which the cam pivots to the first position when the cam is in the second position; and an interlocking mechanism configured to cause the cam to pivot from the first position to the second position in conjunction with change of state of the cover member from a closed state to an open state, wherein the power transmission member includes a rotation shaft extending in the first direction and configured to rotate under the driving force of the drive portion, the cam is pivotable on the rotation shaft, the cam includes a first pivot portion configured to pivot on the rotation shaft and an inclined portion inclined from an end of the first pivot portion facing a third direction opposite the first direction in the third direction relative to the second direction, and the image forming apparatus further comprises a pushing member disposed on a side of the cam facing the third direction to be displaceable in the third direction and configured to push the power transmission member in the third direction when the pushing member is displaced in the third direction by the inclined portion pivoting in a fourth direction opposite the second direction.

2. The image forming apparatus according to claim 1, wherein the first pivot portion has a ring shape, wherein the pushing member includes a second pivot portion having a ring shape with an outside diameter smaller than an inside diameter of the first pivot portion and enclosing the rotation shaft and a contact portion protruding outward from an outer peripheral portion of the second pivot portion in a radial direction of the second pivot portion and brought into contact with the inclined portion, the image forming apparatus further comprising:

a pivot restricting portion configured to restrict the pushing member from pivoting on the rotation shaft.

3. The image forming apparatus according to claim 2, wherein the contact portion includes a contact surface brought into surface contact with the inclined portion.

4. The image forming apparatus according to claim 1, wherein the interlocking mechanism causes the cam to pivot from the second position to the first position in conjunction with the change of state of the cover member from the open state to the closed state.

5. The image forming apparatus according to claim 1, further comprising a closure preventing portion capable of preventing the change of state of the cover member from the open state to the closed state.

6. An image forming apparatus comprising:

a cover member capable of opening and closing an opening of a housing, the opening communicating with a detachable portion detachably disposed inside the housing;

a power transmission member displaceable between a connected position where the power transmission member is connected to the detachable portion and a released position where the power transmission member is disconnected from the detachable portion and configured to transmit driving force of a drive portion to the detachable portion while the power transmission member is connected to the detachable portion;

a bias portion configured to bias the power transmission member in a first direction along which the power transmission member is displaced from the released position to the connected position;

a cam pivotable between a first position and a second position set in advance, configured to pivot from the first position to the second position to displace the power transmission member from the connected position to the released position, and biased by the bias portion in a second direction along which the cam pivots to the first position when the cam is in the second position;

an interlocking mechanism configured to cause the cam to pivot from the first position to the second position in conjunction with change of state of the cover member from a closed state to an open state; and a closure preventing portion capable of preventing the change of state of the cover member from the open state to the closed state.

7. The image forming apparatus according to claim 6, wherein the power transmission member includes a rotation shaft extending in the first direction and configured to rotate under the driving force of the drive portion, and the cam is pivotable on the rotation shaft.

8. The image forming apparatus according to claim 7, wherein the cam includes a first pivot portion configured to pivot on the rotation shaft and an inclined portion inclined from an end of the first pivot portion facing a third direction opposite the first direction in the third direction relative to the second direction, and the image forming apparatus further comprises a pushing member disposed on a side of the cam facing the third direction to be displaceable in the third direction and configured to push the power transmission member in the third direction when the pushing member is displaced in the third direction by the inclined portion pivoting in a fourth direction opposite the second direction.

9. The image forming apparatus according to claim 8, wherein the first pivot portion has a ring shape, the pushing member includes a second pivot portion having a ring shape with an outside diameter smaller than an inside diameter of the first pivot portion and enclosing the rotation shaft and a contact portion protruding outward from an outer peripheral portion of the second pivot portion in a radial direction of the second pivot portion and brought into contact with the inclined portion, and the image forming apparatus further comprises a pivot restricting portion configured to restrict the pushing member from pivoting on the rotation shaft.

10. The image forming apparatus according to claim 9, wherein the contact portion includes a contact surface brought into surface contact with the inclined portion.

11. The image forming apparatus according to claim 6, wherein the interlocking mechanism causes the cam to pivot from the second position to the first position in conjunction with the change of state of the cover member from the open state to the closed state.

* * * * *